United States Patent [19]

Huber

[11] Patent Number: 4,936,350

[45] Date of Patent: Jun. 26, 1990

[54] SEWAGE SYSTEM ISOLATION VALVE ASSEMBLY

[76] Inventor: Donald G. Huber, P.O. Box 64160, Tacoma, Wash. 98464

[21] Appl. No.: 190,591

[22] Filed: May 5, 1988

[51] Int. Cl.[5] ..... F16K 7/00

[52] U.S. Cl. ..... 138/90; 137/68.1; 251/294

[58] Field of Search ..... 251/294, 339; 137/68.1, 137/797, 67; 138/89, 90, 92; 73/49.8; 277/DIG. 10

[56] References Cited

U.S. PATENT DOCUMENTS

| | | | |
|---|---|---|---|
| 3,132,685 | 5/1964 | McKinnon | 251/294 X |
| 4,142,371 | 3/1979 | Mayfield | 138/89 X |
| 4,602,504 | 7/1986 | Barber | 138/89 X |
| 4,706,402 | 11/1987 | Barber | 138/89 X |

*Primary Examiner*—John Fox

*Attorney, Agent, or Firm*—David L. Garrison

[57] ABSTRACT

The present invention is a sewage system isolation valve assembly designed to be installed between a sewage drainage line of a building and a sewage service line. In its initially closed position, the isolation valve assembly provides a closure means for closing and isolating the operating sewage system of the building, thereby permitting the drainage system of the building to be filled with water for testing purposes. Once the testing procedures are complete, a test shut-off baffle may be torn or detached from a gasket which is securely attached or secured within the sewer drainage system. The test shut-off baffle is removed from the isolation valve assembly by pulling on a removal means.

18 Claims, 4 Drawing Sheets

SEWAGE SYSTEM ISOLATION VALVE ASSEMBLY

TECHNICAL FIELD

This invention relates to a sewage system isolation valve assembly designed to be installed within the sewer drainage system of a building. More particularly, this invention relates to a sewage system isolation valve assembly designed to be installed between a sewage line of a newly constructed or repaired sewer drainage system of a building and a sewage service line, thereby isolating the sewage line from the sewage service line.

BACKGROUND ART

In housing construction, a newly installed or repaired operating sewage line of a home's waste or sewer drainage system must remain isolated from the sewage service line until the plumbing construction is inspected and certified. It is common practice within the construction industry to place an outlet end of a newly installed sewage line of the building at a juncture near an inlet to a sewage service line. At this point in construction, these two lines are not connected. Where these two lines would otherwise meet, each line is capped-off until testing and inspection is complete. Usual construction techniques often require that the juncture be buried before the tests are performed. After the testing and inspection is complete, the juncture is re-excavated and a proper connection of the two lines is made.

Various patents have been issued with respect to test or isolation valve assemblies.

Sullivan (U.S. Pat. No. 4,429,568) discloses a closure plug for pressure testing a liquid drain and vent plumbing type system. Sullivan uses a clean-out Y for access to open the plug plate assembly.

Cohen (U.S. Pat. No. 1,720,819) discloses a test T having a tapered gate which closes off a house drain pipe from a drainage system. After the test has been completed, the gate is removed from the test T and the resulting opening in the tee is closed by a cover plate.

Tagliarnio (U.S. Pat. No. 4,542,642) discloses a test tee having a plug which is a removable blocking disk. The blocking disk engages a ledge in the test tee and seals the drainage system. The disk is accessible and removable through an access means.

Roberson (U.S. Pat. No. 4,658,861) discloses a pneumatic plug inserted through a clean-out T to block off a house service line to a main sewer line.

Kennedy (U.S. Pat. No. 1,948,220) discloses a test plumbing system using a flap valve which is pivoted at an upper side of a valve seat. The flap valve is held in position by a valve adjusting rod.

Applicant believes the listed patents and known procedures taken alone or in combination neither anticipate nor render obvious the present invention. The listed references only relate to the general field of the disclosure. These citations do not constitute an admission that the references are relevant or material to the claims. These references are cited only as constituting the closest art of which the applicant is aware.

DISCLOSURE OF INVENTION

It is the general object of the present invention to provide a secure closure means of a sewer drainage system of a building which may be used for isolation and testing purposes.

A further object is to provide a simplified sewage system isolation valve assembly having a gasket and a test shut-off baffle located between an operating sewage line of a building and a sewage service line of a public or private sewer system.

A still further object is to provide an isolation valve assembly which may be held in position within the juncture of a sewage operating line and a sewage service line.

Another object is provide an isolation valve assembly having sufficient strength and resiliency to resist the hydraulic test pressure applied to the drainage system of the building during construction and testing procedures.

Another object is to provide an isolation valve assembly which may be easily and quickly installed within the sewer drainage system of a building.

Another object is to provide an isolation valve assembly having a test shut-off baffle which is easily removable from the assembly without requiring the juncture where the assembly is located to be unearthed, disconnected, dismantled, or reconnected to the sewage service line.

Another object is to provide an isolation valve assembly having only a few parts which does not incorporate the complex and expensive hardware required by the above identified patents.

Another object is to provide a means of isolating certain parts of a large plumbing waste system, such as the upper floors of a multi-story building, in a manner that does not require disassembly of the plumbing system to remove the isolation valve. Because of the pressure generated by the height, some plumbing waste systems must be tested in sections.

The present invention is a sewage system isolation valve assembly designed to be installed within a sewer drainage system of a building. The isolation valve assembly may be used to isolate a sewage line of the newly constructed or repaired sewer drainage system of the building from a sewage service line.

This invention is particularly well adapted for use in residential buildings using a grade level sewer drainage system, wherein the operating sewage line must be isolated from the sewage service line during construction and testing operations. Many building codes require that newly constructed or repaired drainage systems of a building be isolated from the sewage service line during construction, repair, testing, and inspection procedures. Where a grade level sewage system and prior art practices are being used, the ends, which would otherwise form the juncture between the sewage line of the building and the sewage service line, are usually capped and buried. After the inspection of the drainage system is complete, the juncture is unearthed, the caps are removed, the juncture is connected, and the juncture is then reburied. This invention eliminates the need to cap the ends of the sewage line and sewage service line prior to testing. This invention also eliminates the need to unearth the juncture to connect these two sewage lines after the test is complete.

The isolation valve assembly comprises a gasket, a readily removable test shut-off baffle, valve, or plug, and a removal means.

The gasket is appropriately shaped and dimensioned to allow for a secure, sealed fitting when it is located within a sewer drainage system. The gasket may be juxtaposed between the butting ends of adjoining sewage lines. Alternatively, the gasket may be inserted and secured within a single sewage line or conduit. This may be done with an adhesive or by shaping or dimensioning the gasket in such a way as to enable the assembly to be lodged in a sealed manner within a desired sewage line or conduit.

The test shut-off baffle may be removably attached to the gasket, or molded as a removable part thereof. Preferably, the test shut-off baffle is removably attached to the inside edges or walls of the gasket. The shut-off baffle provides a barrier or closure means to isolate the operating sewage line from the sewage service line during construction and testing. The shut-off baffle may comprise a variety of embodiments. The preferred embodiment of the test shut-off baffle is a diaphragm or membrane-type closure means which can be torn or removed from the gasket by the pulling of a removal means.

The removal means may comprise a connecting filament line, cable, or cord which is molded or embedded within the test shut-off baffle. Alternatively, the removal means may be attached to the test shut-off baffle and still serve the same function The removal means is so positioned against or within the shut-off baffle as to permit the shut-off baffle to be removed or disconnected from the gasket when the removal means is pulled. This construction allows the shut-off baffle to be readily removed from the gasket by pulling on the removal means, thereby breaking the seal and tearing the shut-off baffle from of the gasket. The removal means may extend from the shut-off baffle along the sewer drainage system to exit or be located near an access or clean-out port. After the sewage drainage system of the building has been constructed, repaired, pressure tested, and inspected for leaks, the removal means may be pulled through the access port. This pulling action of the removal means detaches or tears the shut-off baffle so that it becomes disconnected from the gasket. The removal means is so connected to the shut-off baffle that, once the shut-off baffle is disconnected from the gasket, the shut-off baffle may be removed from the sewer drainage system by being pulled out through the access port by the removal means. The removal means may comprise a variety of filament lines, cable, or cords used together. For example, a cable or cord may be connected to a filament line which is embedded within the membrane of the shut-off baffle.

The isolation valve assembly, and particularly the test shut-off baffle and gasket, are appropriately shaped and dimensioned to seal the operating sewage line of the building and resist the hydraulic pressures exerted on them during construction and testing procedures. The shut-off baffle is also appropriately shaped and dimensioned to allow little or no resistance to hydraulic flow within the sewer drainage system once the shut-off baffle and removal means have been removed. This may be done by designing and positioning the shut-off baffle so that it has the same outer diameter as the interior diameter of the line or conduit. The removal means should also tear or disconnect the shut-off baffle in such a manner as to allow for easy removal of the baffle from the sewage system after the testing has been performed.

BEST MODE FOR CARRYING OUT THE INVENTION

Figure 1:
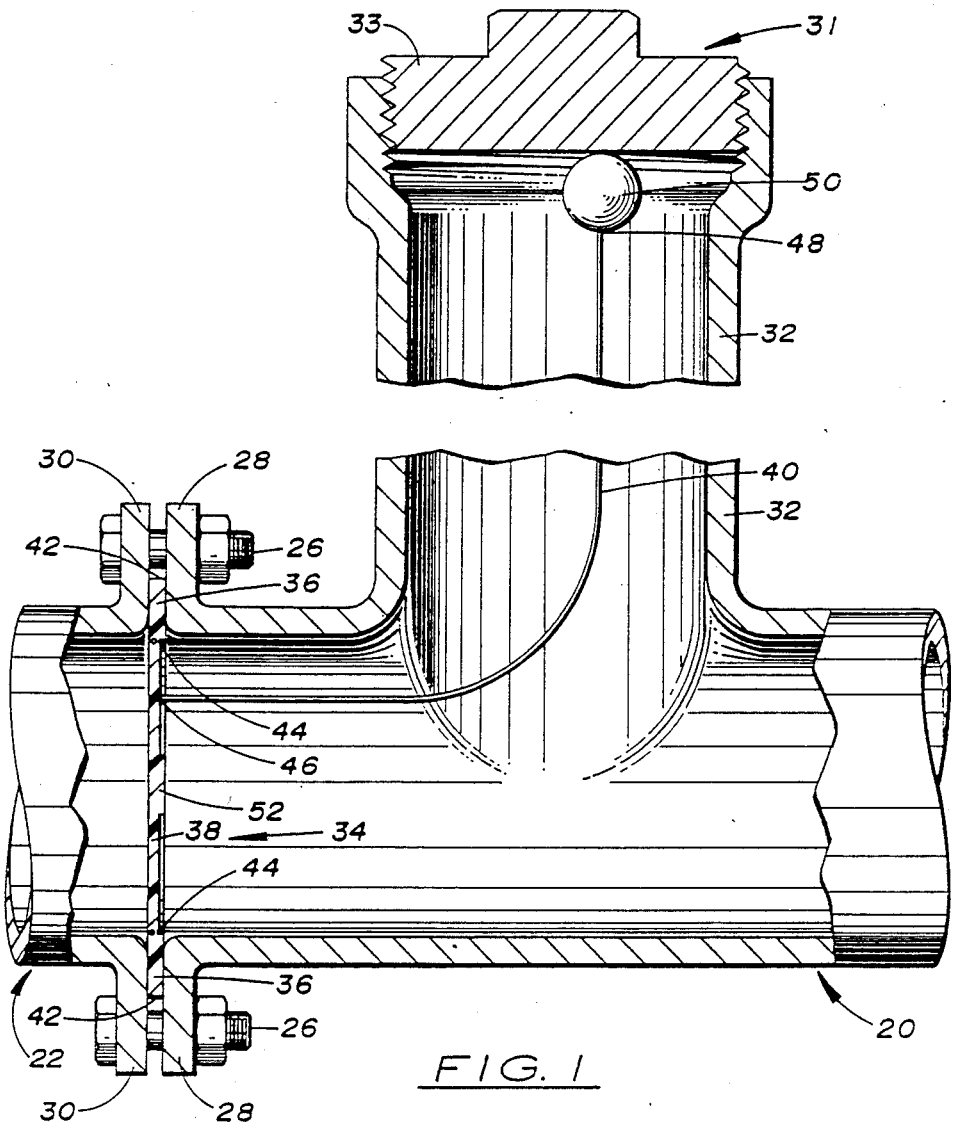
FIG. 1 is a side elevational view, partially in section, of an operating sewage line, a service sewage line, and a sewage system test valve assembly of the present invention.
Figure 4:
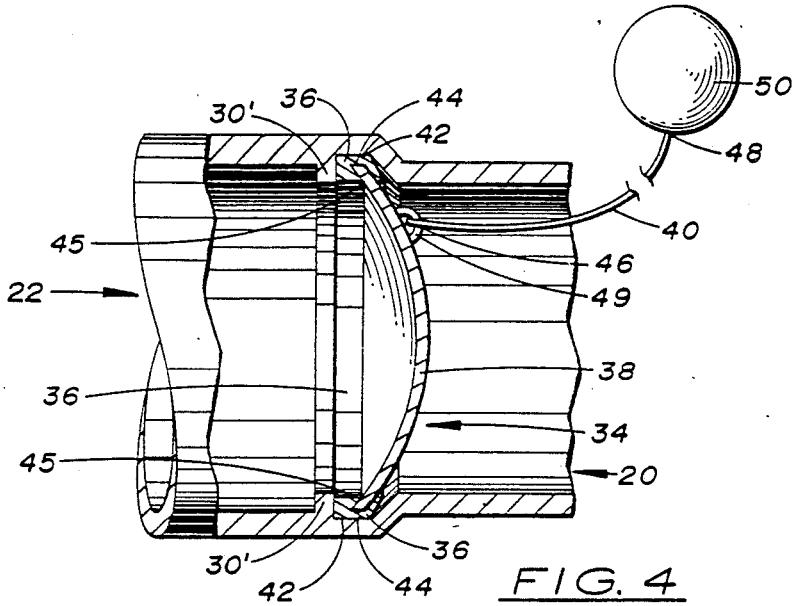
FIG. 4 is a side elevational view, partially in section, of a second embodiment of the present invention.
Figure 5:
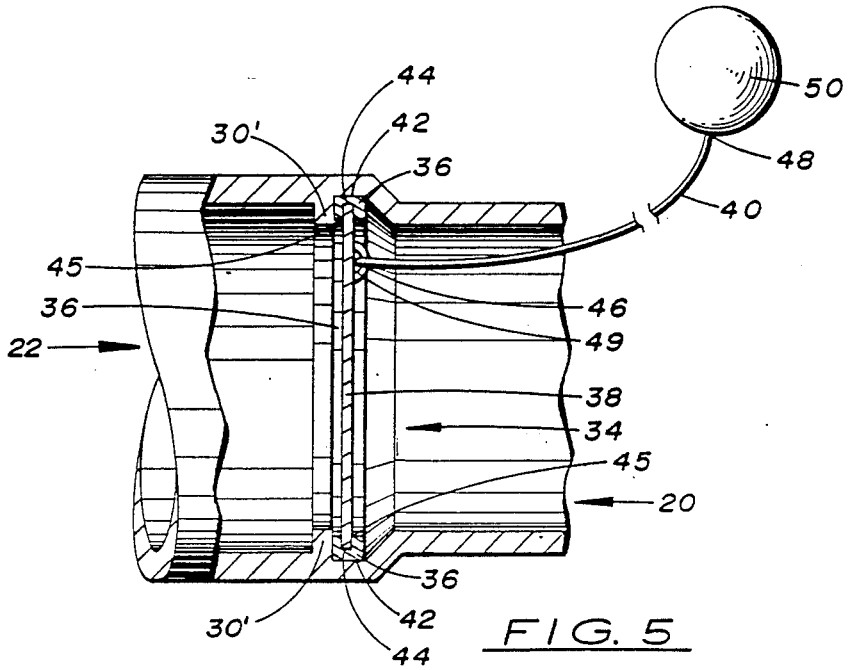
FIG. 5 is a side elevational view, partially in section, of a third embodiment of the present invention.

Referring to the drawings, and particularly to FIG. 1, wherein like numerals indicate like parts, a drainage system of a building, which has a sewage line 20 of somewhat conventional design, is connected to a sewage service line 22. The juncture between sewage line 20 and sewage service line 22 defines a fluid outlet through which fluid might communicate between sewage line 20 and sewage service line 22. Sewage line 20 and sewage service line 22 may be connected by any conventional means. FIG. 1 shows sewage line 20 being connected to sewage service line 22 by fasteners 26 which pass through flanges 28 and 30 which are formed within sewage line 20 and sewage service line 22 respectively. FIGS. 4 and 5 show the use of a test adaptor which may be placed between sewage line 20 and sewage service line 22. Sewage line 20 usually has a clean-out port, access opening, access port 31, or the like, located near the juncture of sewage line 20 and sewage service line 22. Access port 31 may be of any conventional design and is usually located at the top of a clean-out riser pipe 32. FIG. 1 shows access port 31 having a plug 33 which is threadably engaged with cleanout riser pipe 32.

Isolation valve assembly 34 comprises a gasket 36, a readily removable test shut-off baffle 38, and removal means 40. Isolation valve assembly 34 is positioned within the drainage system of the building to isolate sewage line 20 from sewage service line 22. Isolation valve assembly 34, and particularly gasket 36 and test shut-off baffle 38, are appropriately shaped and dimensioned to seal and isolate sewage line 20 from sewage service line 22. Isolation valve assembly 34 is also of sufficient resiliency and strength to resist the hydraulic pressures exerted on it during construction and testing procedures.

Figure 6:
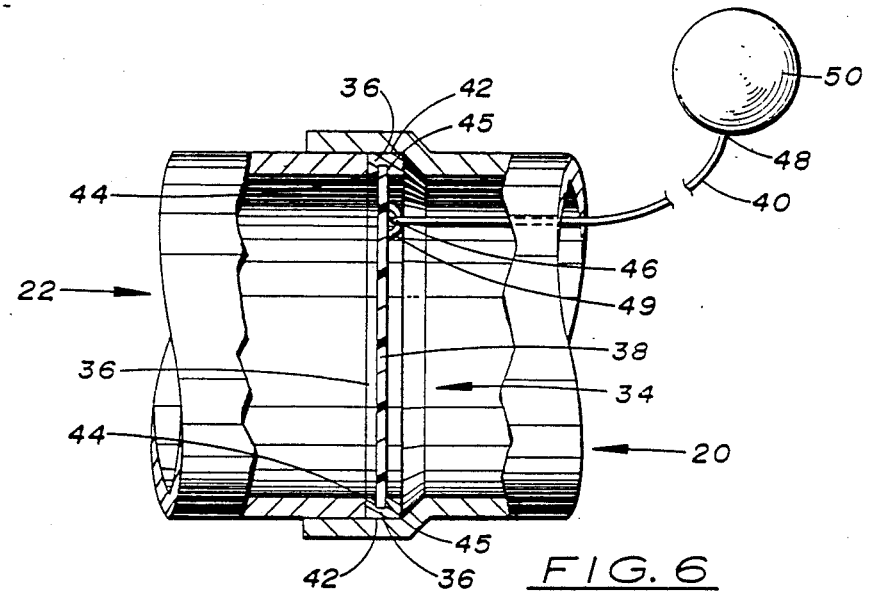
FIG. 6 is a side elevational view, partially in section, of an alternative embodiment of the present invention.

Isolation valve assembly 34 is designed to provide a secure, sealed fitting within sewage line 20. Isolation valve assembly 34 may be positioned in fluid-tight series communication between sewage line 20 and sewage service line 22, as shown in FIGS. 1 and 6, wherein gasket 36 is located near the fluid outlet of sewage line 20 and is juxtaposed between the butting ends of sewage line 20 and sewage service line 22. As shown in FIG. 1, gasket 36 is compressed between flanges 28 and 30 by fasteners 26. Gasket 36 may also be appropriately shaped and dimensioned to pass into an interior of sewage line 20, as shown in FIGS. 4 and 5, with gasket 36 having an outer wall 42 and an inner circumference 44. Outer wall 42 may then be secured to the interior walls of sewage line 20 with an adhesive to provide fluid-tight engagement with the interior walls of sewage line 20. Another embodiment includes gasket 36 being shaped and dimensioned in such a way as to enable isolation valve assembly 34 to be lodged in a sealed manner within a desired portion or conduit of sewage line 20. As shown in FIGS. 4 and 5, gasket 36 may be placed within a recess which is located within the interior walls of sewage line 20. A flange 30' may be located on the sewage service line side of gasket 36 to provide a stop or brace for gasket 36. In this manner, flange 30' holds gasket 36 in place. Gasket 36 may be made of rubber or other suitable material.

Alternatively, isolation valve assembly 34 may be positioned within a conventional spigot and hub joint as shown in FIG. 6. this configuration allows the use of a rigid or semirigid isolation valve assembly 34.

Gasket 36 is preferably shaped and dimensioned to allow little or no resistance to hydraulic flow within sewage line 20 after test shut-off baffle 38 and removal means 40 have been removed. This may be done by designing and positioning test shut-off baffle 38 so that it has relatively the same outside diameter as the interior diameter of sewage line 20, thus providing a generally smooth flow path for sewage line 20 with little or no obstruction when test shut-off baffle 38 is removed.

Figure 2:
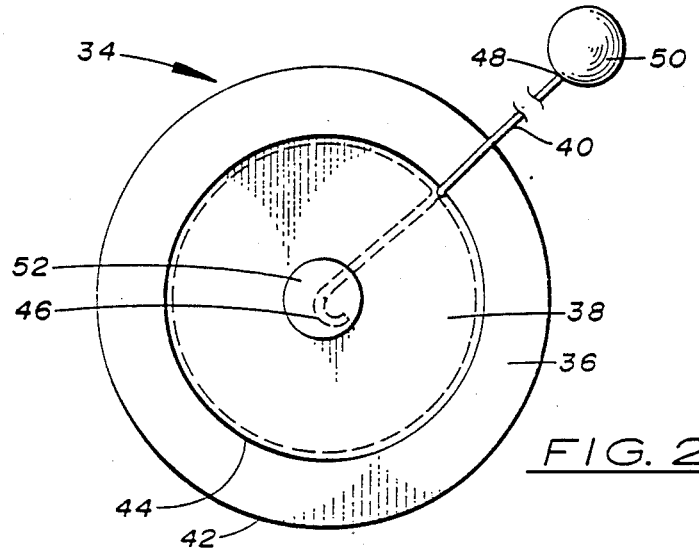
FIG. 2 is an enlarged plan view of a preferred embodiment of a test valve assembly as described herein.
Figure 3:
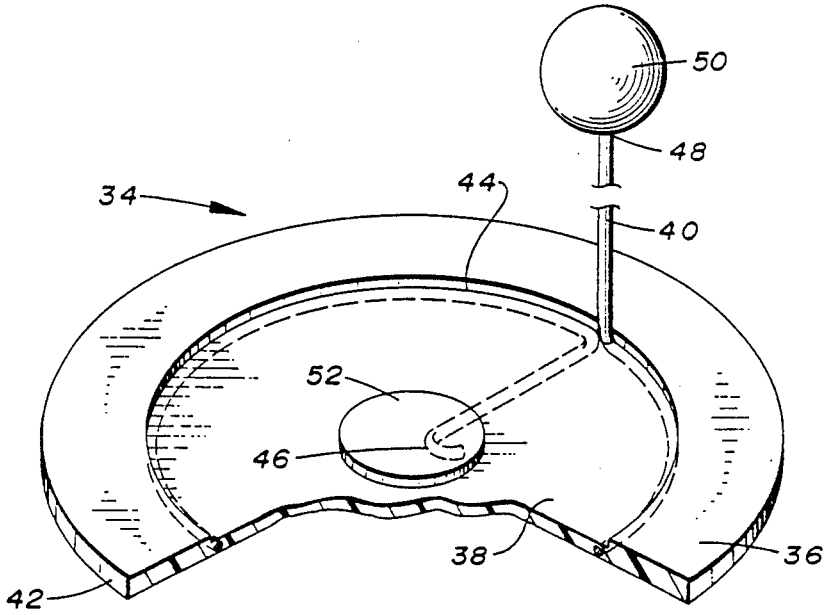
FIG. 3 is an enlarged partial perspective view of the test valve assembly shown in FIG. 2 with a portion broken away to show the interrelationship of the gasket, test shut off baffle, and removal means.

Test shut-off baffle 38 provides a barrier or closure means to isolate the operating sewage line 20 from sewage service line 22 during construction and testing procedures. Test shut-off baffle 38 and gasket 36 form a closure or seal of the fluid outlet of sewage line 20. Test shut-off baffle 38 should be shaped and dimensioned to close or seal an area of gasket 36 which is defined by an inner circumference 44 of gasket 36. Test shut-off baffle 38 may comprise a variety of embodiments, the preferred embodiment is a diaphragm or membrane-type closure means which can be torn-out by removal means 40. The preferred embodiment is shown in FIGS. 1, 2, and 3. Test shut-off baffle 38 may be integrally but removably connected or removably attached to gasket 36 about inner circumference 44. For example, test shut-off baffle 38 may be molded as a part of gasket 36 to form a water impermeable thin plastic or metallic diaphragm, disk, or membrane-type closure which has a portion of removal means 40 molded into the membrane, or attached thereto, about inner circumference 44. By pulling on removal means 40, the membrane attaching test shut-off baffle 38 to gasket 36 is broken or torn, thereby disconnecting test shut-off baffle 38 from gasket 36.

Alternatively, as shown in FIGS. 4 and 5, gasket 36 may define an internal ledge 45 disposed within the interior of sewage line 20. Test shut-off baffle 38 may comprise a blocking disk, sealingly engaging ledge 45 for temporarily preventing a flow of fluid from sewage line 20 to sewage service line 22 during construction or testing of the drainage system of the building. Test shut-off baffle 38 may have a flat configuration as shown in FIG. 5, or test shut-off baffle 38 may have a concavo-convex configuration as shown in FIG. 4. The outer edges of test shut-off baffle 38 are configured to cooperate with a corresponding seat design in ledge 45 of gasket 36. An annular shaped seat is shown in FIG. 5. A concavo-convex shaped seat is shown in FIG. 4.

Figure 7:
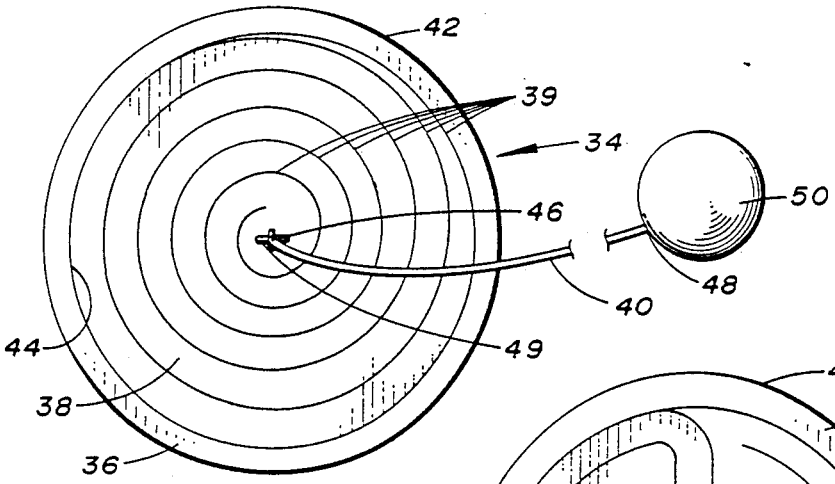
FIG. 7 is an enlarged plan view of an alternative embodiment of a test valve assembly as described herein.
Figure 8:
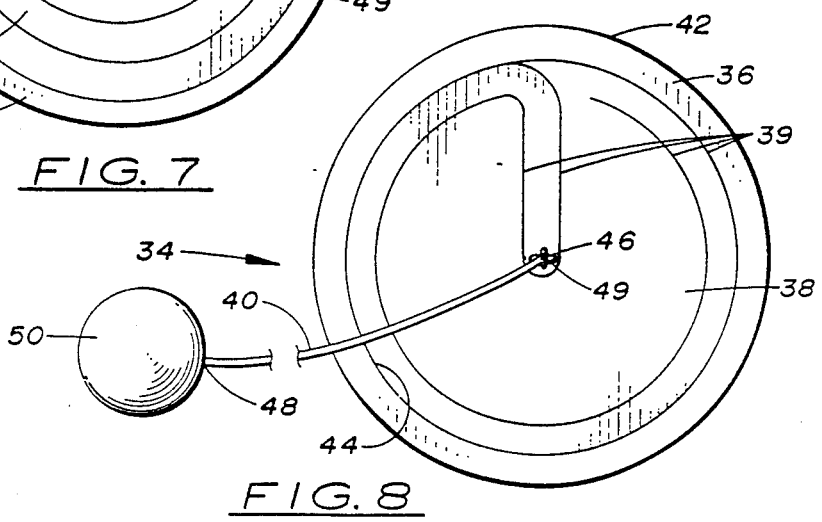
FIG. 8 is an enlarged plan view of another alternative embodiment of a test valve assembly as described herein.

Other alternative embodiments of isolation valve assembly 34 are shown in FIGS. 7 and 8, wherein an indentation or score line 39 is provided in test shut-off baffle 38. Score line 39 allows test shut-off baffle 38 to be easily torn and unraveled during the removal procedures. FIG. 7 shows test shut-off baffle 38 having a spiral score line 39. FIG. 8 shows test shut-off baffle 38 having a circumferential score line 39. Gasket 36 and test shut-off baffle 38 may be formed from a single unitary plate with the outermost perimeter of score line 39 forming inner circumference 44. Test shut-off baffle 38 may be unseated or disconnected from gasket 36 and removed from sewage line 20 by pulling on removal means 40.

Removal means 40 is used to unseat or disconnect test shut-off baffle 38 from gasket 36 and remove test shut-off baffle 38 from sewage line 20 after such disconnection. Removal means 40 has a first end 46 and a second end 48. First end 46 is connected to test shut-off baffle 38. Second end 48 is fed through the interior of sewage line 20 to access port 31. Removal means 40 may comprise a connecting filament line, cable, cord, or the like, of which a portion of first end 46 is molded or embedded into test shut-off baffle 38 about inner circumference 44. A portion of removal means 40 is so positioned within or attached to test shut-off baffle 38 as to permit test shut-off baffle 38 to be removed or disconnected from gasket 36 when removal means 40 is pulled. This construction allows the test shut-off baffle 38 to be readily removed from gasket 36 by simply pulling on removal means 40, thereby breaking the seal and tearing or removing test shut-off baffle 38 from gasket 36. In FIGS. 4 and 5, first end 46 is shown attached to a rib 49. Rib 49 is securely attached to test shut-off baffle 38. Rather than tearing test shut-off baffle 38 from gasket 36, FIGS. 4 and 5 show how test shut-off baffle 38 may be seated in gasket 36, and when test shut-off baffle is removed, it may either bend or flex to pull out of the seat or shear the outer edges of gasket 36 which form the seat.

Removal means 40 is appropriately attached to test shut-off baffle 38 to enable the easy removal of test shut-off baffle 38 from sewage line 20 through access port 31. This may be done by having removal means 40 tear or disconnect a portion of the interior area of baffle 38, as shown in FIGS. 1 to 3. Alternatively, removal means 40 may be secured to one side of test shut-off baffle 38, as shown in FIGS. 4 and 5, so that test shut-off baffle 38 will not become jammed within sewage line 20 during removal. Removal means 40 extends from its connection with test shut-off baffle 38 along the interior of the sewer drainage system to exit, or be located near, access port 31.

Floating means 50 may be attached to second end 48 of removal means 40. Floating means 50 may be a floating ball, floating handle or other suitable device. Floating means 50 causes second end 48 to float near access port 31 so that access port 31 may be sealed in a conventional manner without having second end 48 obstruct the closure of access port 31. Floating means 50 may also serve as a handle for removal means 40 to enable easier removal of test shut-off baffle 38.

After the sewage drainage system of the building has been constructed, repaired, pressure tested, and inspected for leaks, removal means 40 is pulled through access port 31. This pulling action of removal means 40 detaches, unseats, or tears test shut-off baffle 38 so that test shut-off baffle 38 becomes disconnected from gasket 36. Removal means 40 is secured to test shut-off baffle 38 so that, once test shut-off baffle 38 is disconnected from gasket 36, test shut-off baffle 38 may be removed from sewage line 20 by being pulled out through access port 31 by removal means 40. A thicker portion 52 is provided in the preferred embodiment at the connection of first end 46 to test shut-off baffle 38 so that removal means 40 does not become detached from test shut-off baffle 38 during removal. Rib 49 serves the same function as thicker portion 52 for the embodiments shown in FIGS. 4 and 5. Removal means 40 may comprise a combination of filament lines, cable, or cords used together. For example, a cable or cord may be connected to a filament line which is embedded within the membrane of test shut-off baffle 38.

Isolation valve assembly 34 may be utilized at many locations within the drainage or plumbing system of a building. For example, isolation valve assembly 34 may be positioned in main plumbing stacks to isolate floors of multi-story buildings. In such cases, a test tee or clean out tee would be placed just above assembly 34 to facilitate the removal of isolation valve assembly 34 without the need to disassemble or assemble the plumbing system after testing.

The present invention also teaches a method of isolating a drainage system of a building for test purposes. An isolation valve assembly 34, as described above, is inserted into the drainage system of the building to close or seal the fluid outlet of sewage line 20 which communicates with sewage service line 22. Isolation valve assembly 34 closes or seals the fluid outlet. The drainage system is then filled with a fluid, usually water, and the drainage system is inspected for any leaks. During the testing procedures, a pressure may be applied to the fluid located within the drainage system. Once the testing and inspection procedures are complete, access port 31 is opened, second end 48 of removal means 40 is obtained and pulled. The pulling of second end 48 tears, unseats, or disconnects test shut-off baffle from gasket 36, thereby breaking the closure or seal of the fluid outlet. The fluid is drained from the drainage system through the fluid outlet, and test shut-off baffle 38 and removal means 40 are removed from the drainage system by their being pulled through access port 31.

In compliance with the statute, the invention has been described in language more or less specific as to structural features. It is to be understood, however, that the invention is not limited to the specific features shown, since the means and construction herein disclosed comprise the preferred form of putting the invention into effect. The invention is claimed in any of its forms or modifications within the legitimate and valid scope of the appended claims, appropriately interpreted in accordance with the doctrine of equivalents.

INDUSTRIAL APPLICABILITY

This invention is particularly effective and well adapted for use in grade level sewage systems in which a newly installed or repaired sewer drainage system of a building must be isolated from a sewage service line. The isolation valve assembly has a gasket secured to the sewer drainage system. A removable test shut-off baffle, valve, or membrane member is either attached to the gasket or designed as an integral part thereof. The removable test shut-off baffle isolates the sewage line of a building construction site from the sewage service line. The sewer connection can be readily made by merely removing the test shut-off baffle, thereby opening the communication between the newly installed house draining system and the sewage service line without requiring the juncture to be unearthed or accessed.

I claim:

1. A sewage system isolation valve assembly for isolating a fluid outlet of a sewage line of a building from a sewage service line, comprising the combination of:
   (a) a test shut-off baffle removably sealed within said sewage line, said test shut-off baffle forming a closure of said fluid outlet; and
   (b) removal means for disconnecting and for removing said test shut-off baffle from said sewage line, said removal means having a first end connected to said test shut-off baffle, said removal means having a second end; and
   (c) a float attached to said second end, said float and second end may enter an access port of said sewage line whereby pulling of said second end disconnects said test shut-off baffle from said sewage line.

2. The apparatus of claim 1, wherein a score line is located on said test shut-off baffle, said score line allowing said test shut-off baffle to be torn and removed from said sewage line when said second end is pulled.

3. The apparatus of claim 2, wherein said score line is spiral.

4. The apparatus of claim 2, wherein said score line is circumferential.

5. The apparatus of claim 1 wherein said baffle has an elongated filament embedded therein attached to said removal means whereby pulling upon said removal means tears said baffle along said filament for removal.

6. The apparatus of claim 1 wherein said baffle is convex.

7. The apparatus of claim 1 wherein said baffle is planar.

8. The apparatus of claim 1 further including a gasket in sealing relationship between said sewage line and said baffle.

9. The apparatus of claim 1 and a flange in said sewage line to provide a stop for said baffle.

10. A sewage system isolation valve assembly for isolating a sewage line of a building from a sewage service line, comprising the combination of:
   (a) gasket being appropriately shaped and dimensioned to be located in an interior of said sewage line, said gasket having an outer wall and an inner circumference, said gasket being securely engaged in fluid-tight engagement with said sewage line, said sewage line having a fluid outlet communicating with said sewage service line, said gasket being positioned near said fluid outlet;
   (b) a test shut-off baffle being shaped and dimensioned to seal an area of said gasket defined by said inner circumference, said test shut-off baffle and said gasket forming a closure of said fluid outlet of said sewage line;
   (c) removal means for disconnecting said test shut-off baffle from said gasket and for removing said test shut-off baffle from said sewage line, said removal means having a first end and a second end, said first end being connected to said test shut-off baffle, wherein pulling of said second end of said removal means causes said test shut-off baffle to be disconnected from said gasket; and,
   (d) a float attached to said second end of said removal means, said float causing said second end of said removal means to rise into an access port of said sewage line.

11. The apparatus of claim 10 wherein said test shut-off baffle is integrally connected to said gasket, a portion of said removal means being attached or imbedded within said test shut-off baffle around said inner circumference of said gasket, said removal means disconnecting said test shut-off baffle from said gasket when said second end of said removal means is pulled.

12. The apparatus of claim 10 wherein said removal means is securely connected to said test shut-off baffle, said removal means enabling the removal of said test shut-off baffle through an access port of said sewage line once said test shut-off baffle has been disconnected form said gasket.

13. The apparatus of claim 10, wherein said gasket defines an internal ledge disposed within said interior of said sewage line, said test shut-off baffle defining a blocking disk sealingly engaging said ledge for temporarily preventing a flow of fluid from said sewage line to said sewage service line during construction of said sewage line or during testing of said sewage line for leaks.

14. The apparatus of claim 13, wherein said test shut-off baffle has a concavo-convex configuration which cooperates with a corresponding concavo-convex shaped seat of said ledge.

15. The apparatus of claim 10 wherein said test shut-off baffle is a water impermeable planar disk.

16. The apparautws of claim 10 wherein said gasket defines an internal ledge disposed within said interior of said sewage line, said test shut-off baffle defining a blocking disk sealingly engaging said ledge for temporarily preventing a flow of fluid from said sewage line to said sewage service line during construction of said sewage line or during testing of said sewage line for leaks.

17. The apparatus of claim 16 wherein said test shut-off baffle has a concavo-convex configuration which cooperates with a corresponding concavo-convex shaped seat of said ledge.

18. The apparatus of claim 10 wherein said gasket is disposed in fluid-tight series communication between said sewage line and said sewage service line.

* * * * *